US006123334A

United States Patent [19]

Norris

[11] Patent Number: 6,123,334

[45] Date of Patent: Sep. 26, 2000

[54] AIRPORT GAME

[76] Inventor: L. Wayne Norris, 22106 Garmisch Way, Brooksville, Fla. 34601

[21] Appl. No.: 09/233,680

[22] Filed: Jan. 19, 1999

[51] Int. Cl.[7] ..... A63F 3/00

[52] U.S. Cl. ..... 273/251; 273/243; 273/254; 273/252; 273/288; 273/285

[58] Field of Search ..... 73/250, 251, 252, 73/254, 236, 242, 243, 248, 249

[56] References Cited

U.S. PATENT DOCUMENTS

| | | |
|---|---|---|
| 3,656,751 | 4/1972 | Glass . |
| 4,049,276 | 9/1977 | Hole . |
| 4,114,891 | 9/1978 | Lawrimore . |
| 4,226,419 | 10/1980 | Wooden . |
| 4,809,987 | 3/1989 | Dvorak . |
| 4,950,912 | 8/1990 | Goldfarb . |
| 5,139,266 | 8/1992 | Mullins . |
| 5,282,630 | 2/1994 | Dupuis . |
| 5,405,140 | 4/1995 | Tarlinden . |
| 5,713,781 | 2/1998 | Catanis . |
| 5,806,852 | 9/1998 | Howes . |

*Primary Examiner*—Jeanette Chapman
*Assistant Examiner*—Vishu Mendiratta
*Attorney, Agent, or Firm*—Dorothy S. Morse; Stephanie C. Morse

[57] ABSTRACT

A board game for two or more players wanting to experience the common pleasures and pitfalls of airline travel, and the method of playing same, which preferably involves a game board, a distinguishable traveler game piece for each player, luggage game pieces which are easily connected and disconnected from traveler game pieces, travel advancing and delaying ticket-styled instruction cards, tokens, and a pair of identically numbered dice. The object of the game is to be the first player to complete a predetermined number of circuits around the game board and return to the Start/Finish "Airport" square by exact count with original luggage. Before play begins, players decide the number of completed circuits required to win. The game board has a continuous travel path around its perimeter with landing sites each having at least one player instruction; a Start/Finish "Airport" square connected to the travel path; two central areas for positioning ticket-styled instruction cards and "lost luggage"; and centrally located airport-related illustrations. Luggage game pieces must be recovered prior to reaching the Start/Finish "Airport" square during each circuit of travel path, not just at the end of the game. Identically numbered dice, in combination with instructions on landing sites and ticket-styled cards which can be selected by players rolling "doubles," are preferably used to determine traveler game piece movement, while tokens are optionally awarded to each player as a tally of the number of completed circuits around the travel path to help determine the game winner.

17 Claims, 3 Drawing Sheets

AIRPORT GAME

BACKGROUND

1. Field of Invention

This invention relates to board games involving air travel, specifically an air travel board game for two or more players, and a method for playing same, which involves an essentially planar game board having a circuitous travel path with at least one instructional message for players to follow on each landing site in the travel path; one game piece for each player that resembles an airline traveler; additional game pieces resembling various types of luggage each adapted for easy connection to and periodic separation from a corresponding traveler game piece during play of the game; airline-ticket-styled cards with flight advancing and flight delay instructional messages thereon; a means for tallying completed flight segments, such as the use of tokens; and a pair of identically numbered six-sided dice or other random number generating means capable of producing "doubles" or a "doubles" equivalent that indicates a player's need to select an airline-ticket-styled card; and wherein the sole purpose of the game is for each player to attempt to be the first player to return to the Start/Finish "Airport" square by exact count with his or her original luggage after completing a predetermined number of flight segments of a simulated airline trip.

2. Description of Prior Art

Board games are an entertaining and popular way for friends and family members to spend time together. Various types of games are available to the public, each with different goals and rules. Some games involve complex strategies and can also require the exchange of money, as well as the purchase of real estate, stocks, other assets, or insurance. Other games challenge the mental concentration and logic of players, requiring them to solve a mystery or answer trivia questions. There are also adventure games through which players encounter a random series of events over which they have varying amounts of control. While the choices players are required to make in adventure games can affect the outcome of play, they typically do not require high levels of concentration or depend upon the determination of a complex game strategy. The present invention is such an adventure game and provides a simple-to-learn and fun-to-play board game which is entertaining, particularly to airline travelers who have personally experienced a variety of delays and lost luggage in their travels, since in addition to personally remembering prior travel experiences during the game, players tend to further enhance play of the game by sharing their stories about such experiences with the other players. The present invention is a fast moving game that does not require the exchange of money or have as its goal the accumulation of assets. Nor does it require any complex reasoning skills. Instead it allows its players to relax, share stories of prior travels, and experience a little friendly competition in trying to complete a simulated airline trip and be the first one back to the Start/Finish "Airport" square with original luggage after completing the required number of flight segment circuits around the game board travel path.

The prior art thought to be mostly closely related to the present invention is disclosed in U.S. Pat. No. 4,114,891 to Lawrimore (1978) wherein players encounter hazards with apparatus simulating interplanetary space travel and each player must try to be the first one to return to headquarters with his or her spaceship intact and operable. The Lawrimore game comprises a board, player pieces, and random selection means. Game pieces have a storage means for accepting fuel tokens, and a player who runs out of fuel en route automatically loses the game and drops out of play. The Lawrimore board has two circuitous paths between which the players can alternatively move through several entry points. Players are also subject to attack by hostile forces and can take offensive action against others. The Lawrimore game has different types of landing sites, one that alters direction of player movement, another that causes players to go into the secondary circuitous path, another in which the player gains or loses critical material for continuing travel, and yet another in which the player is involved in an attack against or by another player. The random selection means identifies the number of landing sites moved by a player during each of his or her turns, as well as the outcome of attacks. The present invention is different from the Lawrimore game in several ways. First, players of the present invention are not confronted by hostile attacks as in the Lawrimore game. Also, the game board of the present invention only has one circuitous travel path and the number of times a player must circle it to win is variable and something that is pre-determined at the beginning of the game by a consensus of players. Further, traveler game pieces in the present invention carry luggage which can periodically become separated from them, the traveler game pieces being weighted to help them balance the luggage during travel around the game board, and there is no provision for players to suddenly and automatically lose the game, such as running out of fuel. In contrast, the exact opposite can happen and a player of the present invention can unexpectedly win the game if he or she draws a ticket-styled card instructing "Return to the airport with luggage." which permits the player to automatically and immediately advance to the Start/Finish "Airport" square. If the player completes the predetermined number of circuits of the board by such advance, the player automatically becomes the game winner. Also, although both games can have tokens, in the Lawrimore game tokens represent fuel levels which when spent cause the player to lose the game, whereas in the present invention tokens are optional and can be used to represent one or more completed revolutions around the circuitous travel path on the board. In addition, all of the designs on the game board surface of the present invention relate to images generally found in and around airports, not star charts or representations of particular geographical locations, as found in the Lawrimore game and other simulated air travel games. Although there are airline ownership games, flight destination board games, airline travel board games in which the goal is to accumulate a predetermined amount of bonus mileage, and tourist board games involving air travel designed to teach players about particular tourist destinations, it is not known to have a simple adventure-style game focusing on the commons experiences of air travelers such as flight delays, loss of luggage, and the sudden unexpected ability to make a connecting flight.

SUMMARY OF INVENTION—OBJECTS AND ADVANTAGES

The primary object of this invention is to provide an adventure-type of board game for the entertainment of its players with its only goal being for players to leave a Start/Finish "Airport" square with luggage and be the first player to arrive by exact count back at the same Start/Finish "Airport" square with the same luggage after completing a specified number of circuits of the game board. It is also an object of this invention to provide a board game that uses actual experiences commonly encountered by modem air travelers to keep them from arriving at the airport with their luggage, or have them suddenly make a connecting flight and complete their travel more promptly than expected. A further object of this invention is to provide a board game that does not involve complex reasoning skills; intense concentration on the part of players; the transfer of money, real estate, or other assets; the purchase of goods or insurance; or the determination of a winner based upon accumulation of wealth. It is also an object of this invention to provide a board game relating to air travel that is fun to play, fast-paced, and simple to learn, which allows young children to participate.

As described herein, properly manufactured and played, the preferred embodiment of the present invention would consist of an airport board game that provides entertainment for two or more people and comprises a planar game board surface with a circuitous travel path around its perimeter; a sufficient number of distinctly marked game pieces resembling human travelers for a maximum of six to eight players; a corresponding number of game pieces resembling luggage which are each distinctly marked for association with a particular traveler game piece and configured for easy attachment and separation from its corresponding traveler game piece; a plurality of airline-ticket-styled cards each having at least one trip advancing or trip delaying instructional message; a plurality of flight segment completion tokens for marking completed circuits of the game board travel path, and a pair of identically numbered six-sided dice for use as a random number generating means for traveler game piece movement and which permits a player to roll the same number on the upper surfaces of both dice, an event know as "doubles" whereupon a player is usually obligated to select an airline-ticket-styled card. The preferred embodiment of the game board is rectangular and has a circuitous perimeter travel path that consists of a variety of mainly rectangular landing sites each having one or more trip advancing or trip delaying instructional messages for players landing thereon. Instructional messages may be repeated on more than one landing site. The preferred embodiment of the game board also has a Start/Finish "Airport" square connected to the travel path which displays two runways, one for take-offs and one for landings, to indicate the direction of travel. Two essentially rectangular areas are also centrally located on the preferred embodiment of the game board, one being identified as the location of a stack of airline-ticket-styled cards and the other centrally being identified as the location for the placement of luggage that becomes separated from its associated traveler game piece during play. The game board of the preferred embodiment of the present invention also has a variety of airport-related illustrations centrally located thereon, which may extend into the game board travel path and act as background decoration for the instructional landing sites to the extent that such illustrations do not obscure in the instructional messages thereon and make them difficult to read.

In the preferred embodiment of the present invention, each player uses a different traveler game piece to mark his or her movement along the circuitous travel path during game play with the traveler game pieces being distinguished from one another by color, configuration, or a combination of both color and shape. Also in the preferred embodiment the luggage game pieces resemble hand-carried luggage, such as a brief case, a wheeled suitcase, a backpack, or a shoulder-carried sport or duffel bag including an elongated bag that might hold tennis rackets, golf clubs, or skis. Each luggage game piece is also marked for easy identification as belonging to a particular traveler game piece through the use of a distinguishing configuration, one or more distinguishing colors, or other type of surface marking. Tokens used in the preferred embodiment can be uniform in configuration, marking, and color, for use by any player to mark completion of a flight segment, or in the alternative an identical number of tokens can be distinctly color marked and reserved for use in association with a particular traveler game piece.

Before play begins, each player of the preferred embodiment selects one traveler game piece for use during game play, attaches a correspondingly color coded luggage game piece to the traveler game piece selected, and places the traveler and luggage combination on the Start/Finish "Airport" square. A consensus of the players determines the number of flight segments required to win the game. The object of the game is be the first player to have his or her traveler game piece complete a simulated airline trip consisting of a predetermined number of flight segments and arrive at the Start/Finish "Airport" square by exact count with its associated piece of luggage. Generally a player will roll both dice to determine the amount of travel path advancement during a turn, however, occasionally instructions given to a player will direct that only one of the dice be rolled. To reach the Start/Finish "Airport" square for the completion of all flight segments, players must either roll a number on the combined upper surfaces of the dice that allows advancement to the Start/Finish "Airport" square by exact count, or upon rolling "doubles" select a ticket-styled instructional card which sends the player directly to the Start/Finish "Airport" square. However, during immediate approach of the Start/Finish "Airport" square and to facilitate landing thereon by exact count, players of the preferred embodiment are permitted to remain on a landing site and not advance according to roll of the dice should in the player's opinion such advancement place the traveler game piece in a position requiring a number less likely to be rolled. Also in reaching the Start/Finish "Airport" square in any flight segment, the player's traveler game piece must have possession of its associated piece of luggage. In the preferred embodiment of the present invention a player's turn generally consists of rolling the dice and moving his or her traveler game piece clockwise around the travel path a total number of landing sites equivalent to the sum of the numbers shown on the upper surfaces of both dice. Flight delay instructions on the landing site upon which the player's traveler game piece becomes positioned, may cause the player to miss a turn and not move according to the dice on his or her next turn, or move in a trip delaying counter-clockwise direction. Upon rolling "doubles" a player selects the uppermost airline-ticket-styled card unless the player's traveler game piece lands on the Start/Finish "Airport" square wherein the player may select an airline-ticket-styled card but is not required to do so. Airline-ticket-styled cards provide additional instructions to players and in the preferred embodiment airline-ticket-styled cards include both advancing and delaying instructional messages such as "Wow! You just made your flight. You may continue." and "We are not boarding your seat number yet. Go back 3 squares." Some ticket-styled cards may be held for possible future use by a player if the instruction thereon cannot immediately be followed. Such cards can be later surrendered as necessary to counteract landing site instructions that would otherwise cause a player to lose luggage or miss a turn. However, players are permitted to hold only one ticket-styled card at a time having a particular luggage retrieval or flight resuming instructional message, and duplicates selected from the stack of ticket-styled cards which cannot be used before the end of a turn must be surrendered and placed on the bottom of the stack of ticket-styled cards by a player before his or her turn is complete.

The description herein provides preferred embodiments of the present invention but should not be construed as limiting the scope of the present airport board game invention. For example, variations may occur in the size, number, configuration, and color of both traveler and luggage game pieces; the type and positioning of illustrations and decorative markings on the center of the game board; the size, length, number, configuration, and surface decoration of the landing sites in the game board travel path; the general direction of travel on the game board; the content of the instructional messages on the game board landing sites and ticket-styled instruction cards; the number of landing sites and ticket-styled instructional cards having the same instructional message; the means of tallying completed flight segments; and the means used to generate a random number for movement of traveler game pieces around the circuitous travel path on the perimeter of the game board, other than those shown and described herein, may be incorporated into the present invention. Thus the scope of the present invention should be determined by the appended claims and their legal equivalents, rather than the examples given.

DETAILED DESCRIPTION OF PREFERRED EMBODIMENTS

Figure 1:
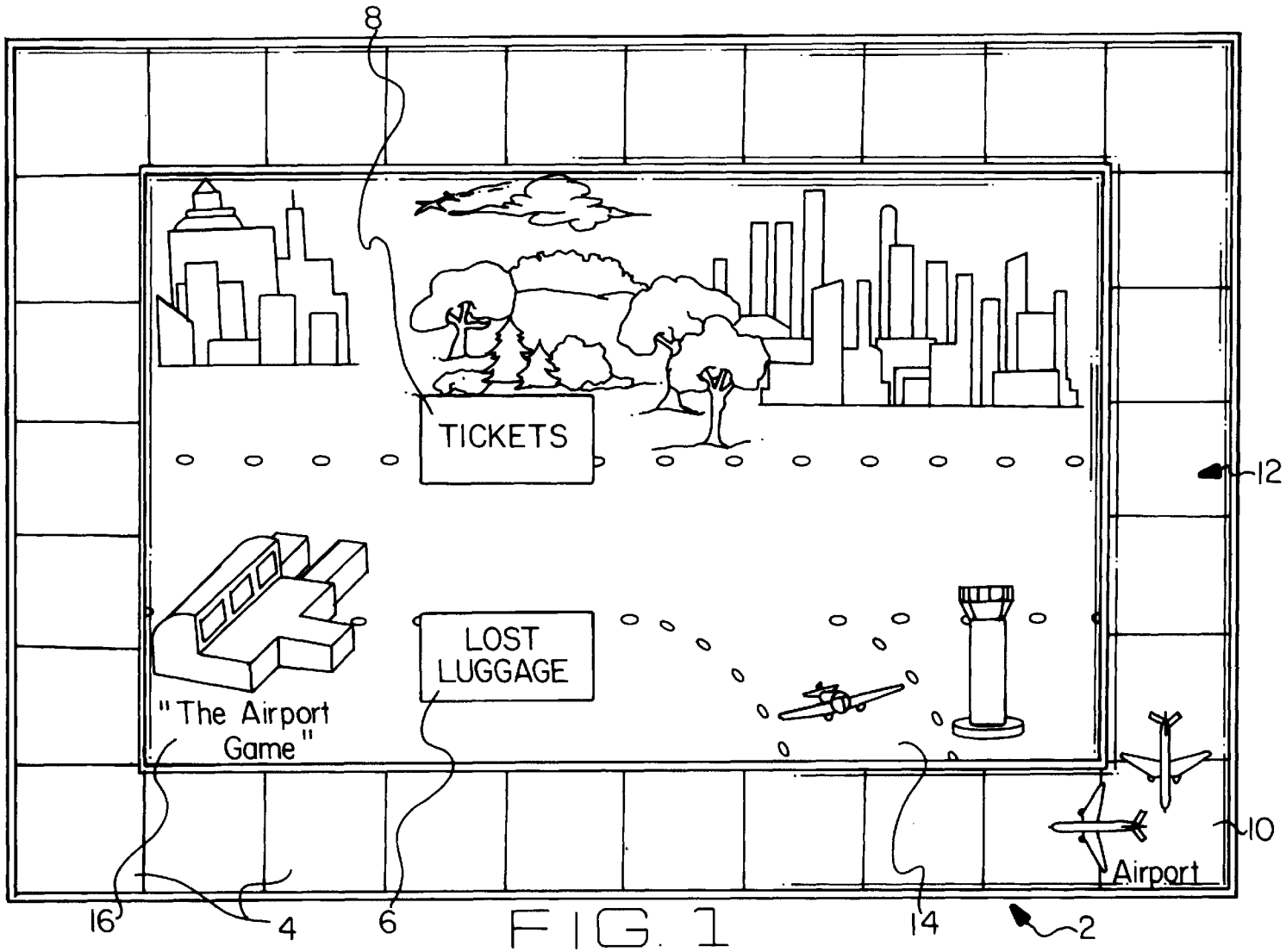
FIG. 1 is a top view of a first preferred embodiment of the game board of the present invention having airport-related illustrations in its center portion, a Start/Finish "Airport" square, two essentially rectangular locations within its center portion with one identified as being for placement of ticket-styled instructional cards, and the other identified for placement of "lost luggage", and a circuitous perimeter travel path with a plurality of landing sites leading to and from the Start/Finish "Airport" square.

The airport game of the present invention is a board game for two or more players (not shown), preferably three or four players to provide for an optimally paced game. The preferred embodiment would have a game board 2 with a travel path 4 leading to and from a Start/Finish "Airport" square 10; six to eight traveler game pieces 18 resembling human travelers each approximately two inches in height and being distinguishable from the remaining traveler game pieces 18 in marking or configuration, with one traveler game piece 18 used by each player of the present invention to mark his or her movement around travel path 4; six to eight luggage game pieces such as hand-carried luggage 26, shoulder-carried luggage 28, and wheeled luggage 30, with each luggage game piece 26, 28, or 30 being identifiable as belonging to a particular traveler game piece 18; approximately three dozen ticket-styled instructional cards 34 each resembling an airline ticket and having at least one travel advancing or travel delaying instructional message thereon; approximately two dozen "flight segment" completion tokens 40; and a pair of identically numbered six-sided dice 32.

In the preferred embodiment game board 2 would be rectangular with a circuitous perimeter travel path 4 consisting of approximately three to four dozen landing sites 12 each displaying at least one instructional message that affects the movement of traveler game pieces 18 stopping thereon. The preferred embodiment of game board 2 would also have two central essentially rectangular locations, one identified as being for the placement of ticket-styled instructional cards 34 and the other identified as being for the placement of "lost" luggage game pieces 26, 28, or 30 which become separated from traveler game pieces 18 during the normal course of play. The overall dimension of game board 2 and the size of each landing site 12 would be in direct proportion to the size of traveler game pieces 18 used, it being contemplated that each landing site 12 would be sufficiently large to accommodate the simultaneous positioning within its borders of at least two traveler game pieces 18 with attached luggage. In the most preferred embodiment of the present invention, the dimensions of traveler game pieces 18 would have a 1:36 scale so that when the traveler game piece 18 shown in FIG. 2 has a two-inch height dimension it would represent a six-foot tall man. The object of the game is for players (not shown) to attempt to be first to have his or her traveler game piece 18 complete a simulated airline trip consisting of a predetermined number of circuits around the perimeter travel path 4 on game board 2, also referred to as "flight segments", and arrive back at the Start/Finish "Airport" square 10 by exact count carrying the same luggage game piece 26, 28, or 30, that was connected to the traveler game piece 18 at the beginning of the game. The present invention does not involve the exchange of money, real estate, stocks, other property, or the purchase of insurance, but instead focuses on players experiencing the same unexpected pleasures and pitfalls commonly encountered during actual air travel. Although the present invention is ideally played by three or four people, a larger group of players can also enjoy play of the game even though the elapsed time between players' turns will increase, since part of the enjoyment of the present invention comes from players sharing actual air travel experiences during play and a larger group of players will have more experiences to share. Also, each player can still roll dice 32 during a subsequent turn to see if "doubles" can be rolled and a ticket-styled instructional card 34 drawn, even when the player is under a "Miss a Turn" restriction that prevents the player from advancing his or her traveler game piece 18 according to the number displayed on the combined upper surfaces of dice 32. Thus players are never completely idle during a "Miss a Turn" restriction which otherwise could lead players to lose interest in play of the game. To enhance enjoyment of the present invention for only two players, the number of "flight segments" required to win the game could be increased or an embodiment of the game could be created for two players which has more landing sites 12 with instructions that delay the players' progress in reaching Start/Finish "Airport" square 10.

Figure 9:
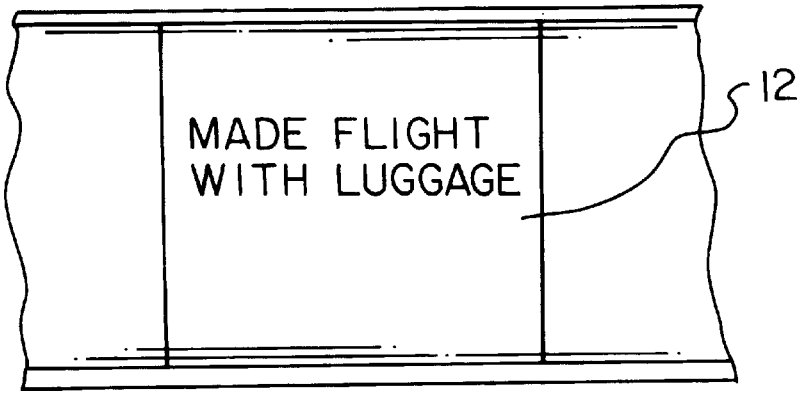
FIG. 9 is an enlarged top view of a first preferred embodiment of a landing site in the game board travel path of the present invention with a typical instructional message centrally positioned thereon intended for affecting the movement of traveler game pieces landing thereon during play.

FIG. 1 shows game board 2 having a rectangular configuration and a perimeter travel path 4 with twenty-nine substantially rectangular landing sites 12 leading to and from one Start/Finish "Airport" square 10. FIG. 1 also shows the landing sites 12 being distributed along the perimeter of game board 2 so that the two longer sides of game board 2 each have eight landing sites 12, the two shorter sides of game board 2 each have five landing sites 12, and the three remaining landing sites 12 each occupy a corner position. However, the number of landing sites 12 used on game board 2 is not critical to the present invention and it is equally contemplated for game board 2 to have more or less than twenty-nine landing sites 12, as well as a different distribution of landing sites 12 along each of the sides of game board 2 other than that illustrated in FIG. 1. Also, although the landing sites 12 shown in FIG. 1 are all similar in size, it is within the scope of the present invention for some landing sites 12 to be larger than others, particularly those having instructional messages tending to detain traveler game pieces 18 thereon, such as the traveler game piece shown in FIG. 2, for extended periods of time making it more likely for more than one traveler game piece 18 at a time to rest upon the landing site 12 for a duration of several turns. Further, it is not critical to the present invention for game board 2 to have a rectangular configuration and it is contemplated for game board 2 to have other configurations for novelty, such as but not limited to the shape of an oval, triangle, hexagon, octagon, or that of an airplane. It is contemplated for each landing site 12 to have at least one flight advancing or flight delaying instructional message, as shown in FIG. 9, for players having traveler game pieces 18 landing thereon to follow.

FIG. 1 also shows travel path 4 connected to opposite sides of Start/Finish "Airport" square 10 which serves as both the original and final destinations of each traveler game piece 18 during play. In the preferred embodiment it is contemplated for Start/Finish "Airport" square 10 to be the largest square within travel path 4 and to contain illustrations relating to airplanes taking off and landing, possibly including one or more runways, and all of which indicate a clockwise direction of movement around travel path 4. Start/Finish "Airport" square 10 may also be identified by the word "Airport" and although not shown in FIG. 1, Start/Finish "Airport" square 10 may further have other words thereon providing explanatory comments or direction of play. In the preferred embodiment it is contemplated for Start/Finish "Airport" square 10 to be sufficiently large for three to four traveler game pieces 18 to be positioned thereon at one time with their attached luggage, such as luggage game pieces 26, 28, and 30. Within the central portion of board game 2, FIG. 1 also shows a rectangular "Tickets" area 8, which is a location designated for the placement of a stack of ticket-styled instructional cards 34, shown in FIGS. 7*a* and 7*b*. FIG. 1 further shows the central portion of game board 2 having a rectangular "Lost Luggage" area 6, which is the area within which players must place their luggage game piece 26, 28, or 30 when directed to do so by instructional messages on a landing site 12 or a ticket-styled instructional card 34. Although both "Tickets" area 8 and "Lost Luggage" area 6 are shown in FIG. 1 to be essentially rectangular in shape and similar in size, their configuration and dimension is not critical and it is contemplated for each to also have other perimeter configurations including that of an airplane, as well as for the "Lost Luggage" area 6 to be larger than "Tickets" area 8 in embodiments of the present invention having larger types of luggage game pieces 26, 28, and 30 or those resembling elongated bags configured for the transport of golf clubs or skis (not shown).

FIG. 1 also shows the central portion of game board 2 containing air travel related illustrations 14. While FIG. 1 shows illustrations 14 including two city skylines, an airport runway and taxiway whose perimeters are marked by lights, two airplanes, one airport building, and an air traffic control tower, the exact composition of illustrations 14 is not critical as long as they tend to make one think of airline travel. Also, although in FIG. 1 illustrations 14 are shown only in the central portion of game board 2, such central placement is not critical and it is also contemplated for at least a portion of illustrations 14 to extend into landing sites 12 and provide decoratively enhancing background markings for landing sites 12. However, such extension of illustrations 14 should be limited to that which does not interfere with the clear interpretation of the words in the instructional messages printed on the surface of each landing site 12. It is also contemplated in the preferred embodiment for the game's name 16, such as "The Airport Game", to be located within the center portion of game board 2. FIG. 1 shows name 16 near to one corner of game board 2, however, it is equally contemplated for name 16 to be placed elsewhere on game board 2 where it would have sufficient height dimension to be readily visible. Further, although not shown in FIG. 1, game board 2 may be marked with linear indentations for bi-fold or tri-fold collapse into a compact configuration for storage.

Figure 2:
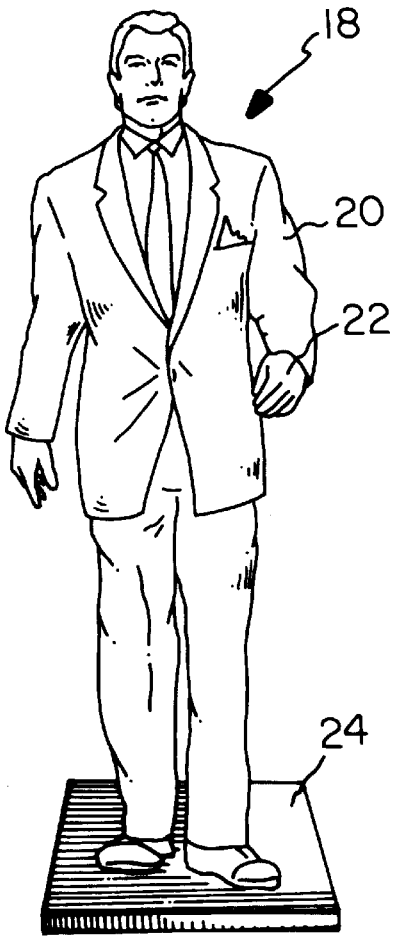
FIG. 2 is a front view of a first preferred embodiment of a traveler game piece to be used by players of the present invention to mark movement along the game board's perimeter travel path, with at least one hand or a shoulder of the traveler game piece being configured for easy connection to one or more corresponding game pieces resembling luggage.

FIG. 2 shows a traveler game piece 18 configured to resemble a human traveler and having a base support 24. Although FIG. 2 shows traveler game piece 18 configured as a business traveler, it is equally contemplated for traveler game piece 18 to be configured as other types of human travelers, such as but not limited to a vacationing tourist or a traveling child. In the preferred embodiment of the present invention, it is contemplated for traveler game pieces 18 to be approximately two inches tall and the size of game board 2, landing sites 12, and luggage game pieces 26, 28, and 30 to be dimensioned in proportion to the size chosen for traveler game pieces 18. All of the traveler game pieces 18 in one embodiment of the present invention may be made from the same mold but have a different color to distinguish one from the other, or each traveler game piece 18 used may have a totally different configuration, or be distinguishable both as to color and configuration. For most economical manufacture, each traveler game piece 18 would have the same configuration and be distinguishable from one another only by color. Base supports 24 are dimensioned to help traveler game pieces 18 remain in an upright position during play while supporting a luggage game piece 26, 28, or 30. In the preferred embodiment it is contemplated for base support 24 to be sufficiently small in size so that two traveler game pieces 18 each with an attached luggage game piece 26, 28, or 30 can easily fit within the borders of the smallest landing site 12. Although not shown, it is also contemplated in the preferred embodiment for base supports 24 to be weighted so as to lower the center of gravity of traveler game pieces 18 and improve their stability during travel path 4 advancement. To achieve such improved stability each base support 24 could be made separately from the upper portions of traveler game pieces 18, from a metallic material having a greater density than the lighter weight plastic contemplated for the upper portions of traveler game pieces 18. Such individually formed base supports 24 would then be attached to the upper portions of traveler game pieces 18 in a separate manufacturing step. In the alternative, base supports 24 and the upper portions of traveler game pieces 18 could be manufactured as a one-piece unit from the same material, such as plastic, with a weight (not shown) later being incorporated somewhere into the bottom portion of base support 24 to achieve the stability and balance desired. In the preferred embodiment, all traveler game pieces 18 would be uniform in shape and have the same extended arm 20 and open hand 22 configured to support any of the luggage game pieces 26, 28, or 30 provided. However, it is also within the contemplation of the present invention to have an alternative preferred embodiment in which each traveler game piece 18 and each piece of luggage is different. As a result one traveler game piece 18 could have a right arm with an open hand 22 to carry luggage game piece 26, another traveler game piece 18 could have a backwards extending left arm with an open hand 22 to pull wheeled luggage game piece 30, and yet other traveler game pieces 18 could have varying extended arms 20 for support of different embodiments of shoulder-carried luggage game pieces 28, such as those configured as a backpack (not shown), a duffel bag, or a specialized sports equipment bag for carrying tennis rackets, golf clubs, or skis.

Figure 3:
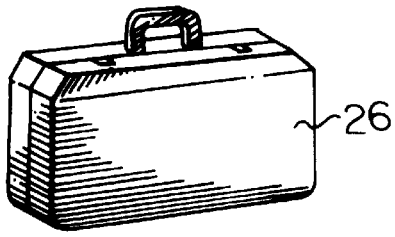
FIG. 3 is a front view of a first embodiment of a luggage game piece which has a thin profile and an upwardly extending handle, and resembles a briefcase or computer lap-top carrying case.
Figure 4:
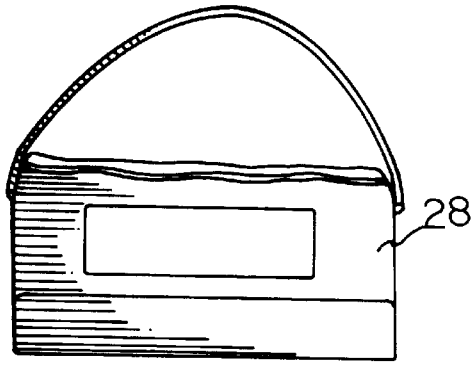
FIG. 4 is a front view of a second embodiment of a luggage game piece which has a shoulder strap and resembles a small soft-sided bag, such as a sports bag or a small duffel bag.
Figure 6:
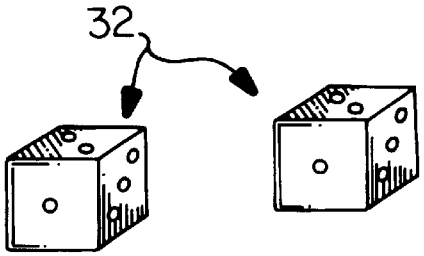
FIG. 6 is a perspective view of a pair of six-sided dice used in the first preferred embodiment of the present invention as a random number generator and one of the means by which the direction and extent of traveler game piece movement is determined, and further which are identically numbered so that a player is able to roll "doubles."
Figure 5:
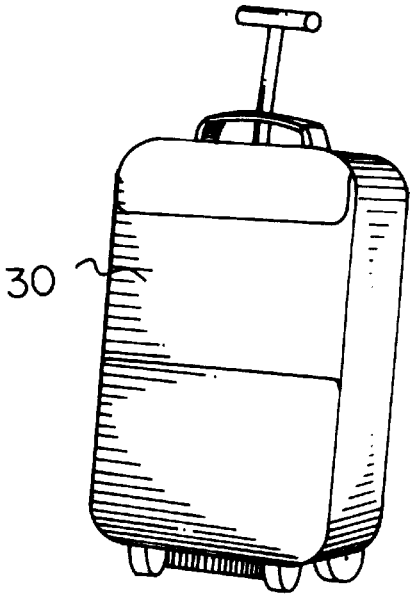
FIG. 5 is a perspective view of a third embodiment of a luggage game piece which resembles a soft-sided suitcase on wheels that is moved by a rigid handle extending upwardly beyond its top surface.

Although the scope of the present invention could conceivably include other hand-carried or checked pieces of luggage, in the preferred embodiment it is contemplated for luggage game pieces 26, 28, and 30 to be limited to luggage that would typically be used as "carry-on" luggage. Further, although in the preferred embodiment it is contemplated for one luggage game piece 26, 28, or 30 to be associated with each traveler game piece 18 used, it is also within the scope of the present invention for more than one luggage game piece 26, 28, or 30 to be associated with each traveler game piece 18. In such embodiments instructional messages on landing sites 12 and ticket-styled instructional cards 34, shown in FIGS. 7*a* and 7*b*, which relate to luggage loss or retrieval could be made to specify application to a single luggage game piece 26, 28, or 30, or to all of the pieces of luggage associated with one traveler game piece 18. FIG. 3 shows one hand-carried luggage game piece 26 configured as a brief case, but although not shown, it is equally contemplated for luggage game piece 26 also include computer carrying cases, train cases, or small duffel bags not having a shoulder strap. FIG. 5 shows a luggage game piece 28 having a shoulder strap, while FIG. 6 shows a luggage game piece 30 which is a small, essentially rectangular soft-sided suitcase, with wheels on its lower end and a telescoping handle on its upper end which is typically rolled along a floor surface during transport instead of being carried. In the preferred embodiment of the present invention, the color of luggage game pieces 26, 28, and 30 would be the same as the color of the traveler game piece 18 with which it was associated. At a minimum, in the preferred embodiment luggage game pieces 26, 28, and 30 would use color or some other readily identifiable means, such as a distinct configuration or a distinct configuration plus color combination, to indicate the traveler game piece 18 with which it should be associated. In addition, although not limited to such restriction, in the preferred embodiment it is contemplated for luggage game pieces 26, 28, and 30 to be lightweight and made from plastic materials.

Figure 7A:
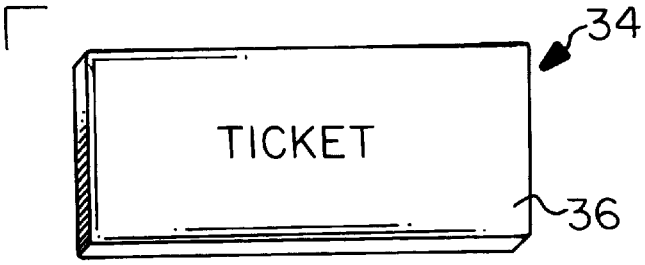
FIG. 7*a* is a front view of a first preferred embodiment of a ticket-styled instructional card of the present invention showing the word "Ticket" positioned on its upper surface.
Figure 7B:
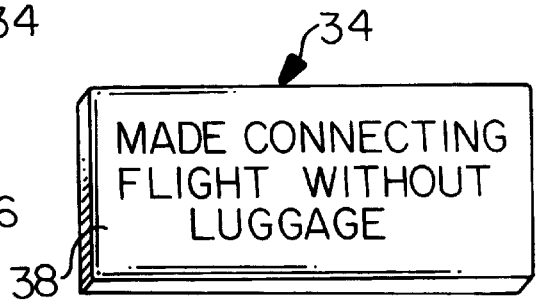
FIG. 7*b* is a back view of the first preferred embodiment of a ticket-styled instructional card showing a typical player instruction centrally located on its lower surface.

FIG. 6 shows pair of six-sided dice 32 having identical numbering on each die so that "doubles" can be thrown during game play to allow players (not shown) to select the ticket-styled instructional cards 34 shown in FIGS. 7*a* and 7*b*. Although six-sided dice 32 are shown in FIG. 6, a pair of random number generators having more or less than six sides for novelty is also within the scope of the present invention. Also, more than one pair of dice 32 could be provided. In the preferred embodiment it is contemplated that dice 32 could be rolled with the player's hands, however it is also contemplated that dice 32 could be rolled from a small cup (not shown) or tossed within a flip-cage (not shown) to minimize the influence some players might try to exert over dice 32 during a roll. Although the use of dice 32 is preferred as a random number generator, it also is within the scope of the present invention to use other forms of random number generation (not shown), such as a wheel which can be rotated by a player or a device having a spinning directional indicator such as an arrow mounted against a surface having numbers and other instructional messages upon it, as long as each random number generator used has a means for achieving "doubles" or a "doubles" equivalent that gives players the opportunity to select ticket-styled instructional cards 34. The amount and direction of player movement during his or her turn is determined by a combination of the numbers shown on rolled dice 32, the flight advancing and flight delaying instructional messages on the landing sites 12 in travel path 4, and the flight advancing and flight delaying instructional messages on the ticket-styled instructional cards 34 selected when a player rolls "doubles."

FIG. 7*a* shows a typical top side 36 of a ticket-styled instructional card 34 and having the word "Ticket" centrally located on top side 36. Although not shown, it is also contemplated for top side 36 to have illustrations or other words thereon which would make top side 36 more closely resemble an actual ticket used by airlines. During play ticket-styled instructional cards 34 are placed in a single stack with top side 36 facing up in "Tickets" area 8 centrally located on game board 2. One ticket-styled instructional card 34 is selected each time a player rolls "doubles" on dice 32 unless the player lands on Start/Finish "Airport" square 10 wherein the player has the option to select a ticket-styled instructional card 34 but is not required to do so. FIG. 7*b* shows a typical bottom side 38 of a ticket-styled instructional card 34 with an instructional message centered thereon. A player (not shown) may keep more than one ticket-styled instructional card 34 in his or her possession during play of the game, but not ticket-styled instructional cards 34 having duplicate instructional messages. Should a duplicate ticket-styled instructional card 34 be selected by a player during his or her turn and not used during the turn, the duplicate ticket-styled instructional card 34 must be returned to the bottom of the stack of ticket-styled instructional cards 34 in "Tickets" area 8 prior to completion of the player's turn. Several dozen ticket-styled instructional cards 34 are preferably used with the present invention and instructional messages may be repeated on more than one ticket-styled instructional card 34. Once a player has complied with the instructions on a selected ticket-styled card 34, the selected ticket-styled instructional card 34 is returned to the bottom of the stack of ticket-styled instructional cards 34 positioned on top of "Tickets" area 8 centrally located on game board 2. Although not critical to the present invention, should a player want to surrender a ticket-styled instructional card 34 to overcome a "Miss a Turn" directive, surrender would preferably take place at the beginning of the player's next turn in which he or she wanted to advance according to the roll of dice 32. Examples of the instructional messages on ticket-styled instructional cards 34 contemplated for use in the preferred embodiment of the present invention are as follows:

"We are not boarding your seat number yet. Go back three squares."

"Wow! You just made your flight. You may continue."

"Too much carry-on luggage. Go back the number of squares on roll of one die."

"Congratulations! We found your luggage. You may continue."

"You just made a direct flight to the airport."

Figure 8:
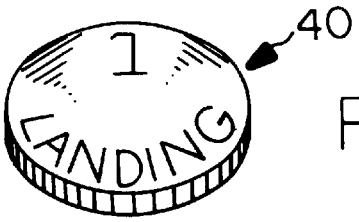
FIG. 8 is a perspective view of a first preferred embodiment of a token of the present invention which would be used with other similar such tokens to tally the number of airport landings a player has completed.

FIG. 8 shows a typical landing token 40 being disk-shaped with the designation "1 Landing" indicated on its top surface, the use of tokens 40 being optional during game play to record completed trip segments. Although the cross-sectional configuration of the landing token 40 shown in FIG. 8 is circular, the cross-sectional configuration of landing tokens 40 is not critical and it is also within the scope of the present invention to have tokens 40 with other cross-sectional configurations such as that of a hexagon, octagon, or an airplane. Although not shown, it is also within the scope of the present invention to include tokens 40 having printed designations such as "1 Landing" or other marking on both top and bottom surfaces, as well as tokens 40 with no word markings or color distinction with the assumption that each such token 40 would represent the completed flight segment of any player. In the preferred embodiment tokens 40 are made from plastic, cardboard, or laminated paper, but such materials are not critical and it is considered within the scope of the present invention for tokens 40 to be made from other materials as well. During play involving more than one circuit of travel path 4, it is contemplated for one token 40 to be distributed to players as they land on Start/Finish "Airport" square 10 after successfully completing each flight segment. It is contemplated for the preferred embodiment of the present invention to include at least two dozen landing tokens 40. Also, although not shown and not critical, it is contemplated for some tokens 40 to have color designations corresponding to a specific travel game piece 18 and for some tokens 40 to have higher denominations, such as "2 Landings" to reduce the total number of tokens 40 required. In the alternative to tokens 40, although not shown, flight segments could be recorded with hand-written notes on a piece of paper or score sheet, or through use of a mechanical means of tallying such information that would involve hand manipulation of buttons, switches, or tabs.

FIG. 9 shows an enlarged view of a typical landing site 12 with its instructional message centrally located thereon. It is contemplated that each landing site 12 on travel path 4 display at least one flight advancing or delaying instructional message, such as "Made connecting flight with luggage." wherein a player may retrieve his or her luggage from the "lost luggage" site 6 on the center of game board 2 and continue to move around travel path 4 during his or her next turn; "Wrong flight. Go back to the airport." wherein the traveler game piece 18 must be repositioned at the Start/Finish "Airport square 10 to restart his or her current flight segment; and "Missed flight. Miss one turn." wherein during a next turn, the player rolls dice 32 but does not move his or her traveler game piece 32 according to dice 32 unless the player can overcome the "missed turn" directive with an opposing ticket-styled instructional card 34, with the roll on dice 32 only being used as an attempt to obtain "doubles" so the player can select a ticket-styled instructional card 34 and follow its instructional message. It is contemplated for more than one landing site 12 on travel path 4 to have the same instructional message, with the order and sequence of repetition for instructional messages varying between different embodiments of the present invention and being determined by the desired pace of play. Should a longer duration be contemplated for game play, game board 2 could be made to contain more landing sites 12 having instructional messages requiring traveler game pieces 18 to move backward, or for players to "Miss a Turn." In the alternative, should a faster paced embodiment of the present invention be desired, more landing sites 12 could give players bonus advancement toward the Start/Finish "Airport" square. The instructional messages used on landing sites 12 generally fall into several categories of messages causing traveler game pieces 18 to miss a turn, unexpectedly advance, lose luggage, temporarily reverse direction of movement around game board 2, and regain luggage. Examples of some of the instructional messages contemplated for use on landing sites 12 in the preferred embodiment of the present invention are as follows:

"Made connecting flight with luggage."

"Wrong flight. Go back to the airport."

"Made connecting flight without luggage."

"Missed flight. Miss one turn."

"Overbooked flight. Miss one turn."

"Plane delayed. Miss one turn."

"Plane re-routed due to bad weather. Miss one turn."

"Lay-over in connecting airport. Miss one turn."

"You forgot to check in at counter. Miss one turn."

"Must have luggage before continuing."

To play the preferred embodiment of the present invention, the players must initially determine the number of completed circuits around travel path 4 required to win the game and the order in which each player will initially leave Start/Finish "Airport" square 10 to start movement around travel path 4. The method for choosing the order of play amongst players is not critical and could be determined by any means, such as the rolling of one or both dice 32 with the player rolling the highest number total on dice 32 going first. Each player would then select a travel game piece 18 and one luggage game piece 26, 28, or 30. All players begin play in succession by placing his or her traveler game piece 18 on Start/Finish "Airport" square 10 and rolling both dice 32. After the player chosen to go first starts the game, players sequentially take turns rolling dice 32 even if under a "Miss a Turn" directive wherein the player is not permitted advancement of his or her traveler game piece 18 according to dice 32 but still can roll dice 32 hopeful to obtain "doubles" and be able to select a ticket-styled instructional card 34 that otherwise directs the player to advance toward to Start/Finish "Airport" square 10. Typically, each player's turn consists of the following steps: the player rolls dice 32 by hand, in a cup (not shown), or in a flip-cage (not shown); the player then advances his or her traveler game piece 18 the number of landing sites 12 toward Start/Finish "Airport" square 10 equivalent to the total number indicated on the upper surfaces of both dice 32; whereafter the player follows the instructional messages displayed on the targeted landing site 12 upon which his or she traveler game piece 18 becomes positioned. If "doubles" is rolled, after moving his or her traveler game piece 18 according to dice 32 and following applicable instructions on the targeted landing site 12, the player rolling "doubles" would then select the uppermost ticket-styled instructional card 34 from the stack of such cards 34 positioned on "Tickets" area 8 and follow the instructional message written thereon, including the further moving of his or her traveler game piece 18 to second and third landing sites 12 if such action is necessary to comply with the instructional message on the selected ticket-styled instructional card 34 and the second landing site 12. Even further movement of the player's traveler game piece 18 could be necessary if so directed by the instructional message on a third landing site 12. The player would also regain or lose his or her original luggage game piece 26, 28, or 30 as directed by instructional messages on landing sites 12 and ticket-styled instructional cards 34, and make appropriate disposition of unused ticket-styled instructional cards 34 before completing his or her turn. Players landing on Start/Finish "Airport" square 10 as a result of "doubles" are permitted to select a ticket-styled instructional card 34 but are under no obligation to do so. Also, if the ticket-styled instructional card 34 selected provides an instructional message that is not immediately applicable to a player's current situation, such as "Found Luggage" or "Continue Flight", the player may save the unused ticket-styled instructional card 34 for future use in overcoming "Lose Luggage" and Miss a Turn" directives, provided he or she does not already have a duplicate thereof in his or her possession. Should more than one identically worded card be in a player's possession during his or her turn, the surplus card must be surrendered to the bottom of the stack of ticket-styled instructional cards 34 in "Tickets" area 8 before the player's turn is completed. Play continues with each of the players (not shown) consecutively taking a turn until one player is able to complete the predetermined number of circuits around travel path 4 and land again by exact count on Start/Finish "Airport" square 10 accompanied by his or her original luggage game piece 26, 28, or 30. Also, not just at the end of the game, but each time a players' traveler game piece 18 lands on Start/Finish "Airport" square 10 to successfully complete a flight segment, it must do so by exact count and with possession of its corresponding luggage game piece 26, 28, or 30.

Generally, with any roll of dice 32 that produces "doubles", such as two, four, six, eight, ten or twelve when six-sided dice 32 shown in FIG. 6 are used, players must move their traveler game piece 18 the indicated number of landing sites 12, select one ticket-styled instructional card 34, follow the instructional message written thereon, and if the message relates to finding luggage or continuing flight and the player is not able to immediately use it, the player can save the ticket-styled instructional card 34 for future use if it is not a duplicate of one already in his or her possession. Exceptions to this conduct occur when a player approaches Start/Finish "Airport" square 10 or can use the random number generated to land directly on Start/Finish "Airport" square 10. Upon landing directly on Start/Finish "Airport" square 10, selection of a ticket-styled instructional card 34 is optional. Further, when players near Start/Finish "Airport" square 10, any movement of their traveler game piece 18 is optional if in the player's opinion his or her opportunity to gain quick access to Start/Finish "Airport" square 10 would be diminished by movement according to a particular roll of dice 32. For example, if a player's traveler game piece 18 is positioned six landing sites 12 away from Start/Finish "Airport" square 10 and the player rolls a "one" and a "three" on dice 32, movement "four" landing sites 12 would place the player's traveler game piece 18 only two landing sites 12 away from Start/Finish "Airport" square 10, and since a "two" has lower odds of being rolled on dice 32 than a "six" the player would probably not move and wait for a more favorable roll in a subsequent turn. Although not critical, in different embodiments of the present invention, the election by players to forfeit movement according to dice 32 during close approach to Start/Finish "Airport" square 10 can be reserved for all landing sites 12 on the side of game board 2 "approaching" Start/Finish "Airport" square 10 or further limited so as to only apply to those landing sites 12 within a specified roll of dice 32 from Start/Finish "Airport" square 10, such as within a maximum of six, eight, ten, or twelve landing sites 12 on any "approach" of traveler game pieces 18 to Start/Finish "Airport" square 10.

What is claimed is:

1. Board game apparatus adapted for playing a simple, easy-to-learn, fast moving game simulating airplane travel during which each in a group of players can periodically lose and retrieve luggage and wherein such loss and retrieval becomes a focal point of said game, and further wherein the winner is the first of said players to complete a simulated airplane trip consisting of a pre-determined number of flight segments by exact count and accompanied by original luggage, said board game apparatus comprising:

a plurality of first game pieces each configured to resemble a human airline traveler, each of said first game pieces also having means adapted for differentiation from the remainder of said first game pieces, each of said first game pieces also having an upper body configuration adapted for connection to hand-supported and shoulder-supported pieces of luggage;

a plurality of second game pieces identical in number to said first game pieces, said second game pieces being configured to resemble hand-supported and shoulder-supported pieces of luggage used for airplane travel, each of said second game pieces also being adapted for rapid and easy connection to and separation from a distinct one of said first game pieces and also being proportioned in size relative to said distinct one of said first game pieces for easy transport thereby during game play;

a game board having an upper surface with a plurality of decorative markings relating to airports, a circuitous perimeter travel path marked on said upper surface and divided into a plurality of consecutively positioned landing sites, each of said landing sites having a surface area dimension adapted for positioning a minimum of two of said first game pieces and two of said second game pieces, each of said landing sites displaying at least one instructional message relating to the pleasures and pitfalls associated with actual airplane travel and adapted for advancing and delaying movement of said first game pieces around said travel path, also at least one of said instructional messages being adapted for causing the one of said first same pieces landing thereon to lose luggage, an enlarged start/finish square adapted to represent an airport being connected between two of said landing sites and having a surface area dimension larger than the largest one of said landing sites, one full circuit of said travel path from said start/finish square and returning to said start/finish square representing one flight segment during game play, an airline ticket card holding area marked on said upper surface of said game board, and a lost luggage holding area also marked on said upper surface of said game board and having a surface area dimension adapted for containment of said second game pieces when temporarily separated from said first game pieces;

a plurality of instructional airline ticket cards, each of said airline ticket cards having a substantially planar configuration adapted for being stacked upon one another in said airline ticket holding area, each of said airline ticket cards having opposing sides and at least one player instruction relating to actual airplane travel displayed on one of said opposing sides, said player instructions being adapted for advancing movement of said first game pieces around said circuitous travel path, delaying movement of said first game pieces around said circuitous travel path, canceling action required by said instructional messages on said landing sites, and directing retrieval of lost luggage, the other of said opposing sides displaying markings relating to actual airline tickets; and a random number generating means adapted for use in identifying the number of landing sites to be advanced consecutively by each of said first game pieces during game play, said random number generating means also being adapted for use in identifying the need for player selection of one of said airline ticket cards during game play.

2. The board game apparatus of claim 1 further comprising a plurality of tokens adapted for use during game play to record completion of said flight segments.

3. The board game apparatus of claim 2 wherein each of said tokens display a numerical indication of completed flight segments represented thereby.

4. The board game apparatus of claim 1 wherein said random number generating means consists of one pair of identically numbered dice.

5. The board game apparatus of claim 2 wherein said random number generating means consists of one pair of identically numbered dice and further wherein said start/finish square has at least one surface marking indicating a preferred direction of movement for said first game pieces around said travel path.

6. The board game apparatus of claim 1 wherein said first game pieces are differentiated from one another by color marking means, and wherein each of said second game pieces have color makings adapted for rapid association with a distinct one of said first game pieces.

7. The board game apparatus of claim 2 wherein said first game pieces are differentiated from one another by color marking means, and further wherein said tokens also have color makings adapted for rapid association with a distinct one of said first game pieces.

8. The board game apparatus of claim 1 wherein each of said first game pieces has a base support and wherein said base support is adapted for balancing said first game piece while one of said second game pieces is connected thereto.

9. The board game apparatus of claim 1 wherein each of said first game pieces and each of said second game pieces is dimensioned according to a 1:36 scale and each of said first game pieces has a height dimension of approximately two inches.

10. The board game apparatus of claim 1 wherein said circuitous path comprises approximately four dozen of said landing sites.

11. The board game apparatus of claim 1 wherein said game board is adapted for compact storage and selected from a group consisting of game boards having a tri-fold configuration and game boards having a bi-fold configuration.

12. The board game apparatus of claim 1 wherein said second game pieces are selected from a group consisting of game pieces configured as briefcase-style hand-carried luggage having one small handle centered on one of its sides, game pieces configured as soft-sided sport-type bags having a shoulder strap, and game pieces configured as carry-on sized luggage having wheels attached to a bottom surface and a retractable T-shaped handle that can extend beyond an upper surface.

13. Board game apparatus for playing a simple, easy-to-learn game, fast moving game simulating airplane travel during which each in a group of players can periodically lose and retrieve luggage and wherein such loss and retrieval becomes a focal point of said game, and further in which the winner is the first of said players to complete a simulated airplane trip consisting of a pre-determined number of flight segments by exact count and accompanied by original luggage, said board game apparatus comprising:

a plurality of first game pieces each having an upper portion configured to resemble a human airplane traveler, each of said first game pieces also having a weighted base support adapted for balancing said first game piece while said first game piece transports luggage, and each of said first game pieces also having means adapted for distinguishing itself from the remainder of said first game pieces and an upper body configuration adapted for connection to hand-supported and shoulder-supported pieces of luggage;

a plurality of second game pieces identical in number to said first game pieces, said second game pieces each being configured to resemble hand-supported and shoulder-supported pieces of luggage used for airplane travel, each of said second game pieces also being adapted for rapid and easy connection to and separation from a distinct one of said first game pieces and also being proportioned in size relative to said distinct one of said first game pieces for easy transport thereby during game play;

a game board having an upper surface with a plurality of decorative markings relating to airports, a circuitous perimeter travel path marked on said upper surface and divided into a plurality of consecutively positioned landing sites, each of said landing sites having a surface area dimension adapted for positioning a minimum of two of said first game pieces and two of said second game pieces, each of said landing sites displaying at least one instructional message relating to the pleasures and pitfalls associated with actual airplane travel and adapted for advancing and delaying movement of said first game pieces around said travel path, also at least one of said instructional messages being adapted for causing the one of said first game pieces landing thereon to lose luggage, an enlarged start/finish square adapted to represent an airport being connected between two of said landing sites and having a surface area dimension larger than the largest one of said landing sites, said start/finish square having at least one surface marking indicating a preferred direction of movement of said first game piece around said travel path, one full circuit of said travel path from said start/finish square and returning to said start/finish square representing one flight segment during game play, an airline ticket card holding area marked on said upper surface of said game board centrally from said travel path, and a lost luggage holding area also marked on said upper surface of said game board centrally from said travel path and having a surface area dimension adapted for containment of said second game pieces when temporarily separated from said first game pieces;

a plurality of instructional airline ticket cards, each of said airline ticket cards having a substantially planar configuration adapted for being stacked upon one another in said airline ticket holding area, each of said airline ticket cards having opposing sides and at least one player instruction relating to actual airplane travel displayed on one of said opposing sides, said player instructions being adapted for advancing movement of said first game pieces around said circuitous travel path, delaying movement of said first game pieces around said circuitous travel path, canceling action required by said instructional messages on said landing sites and directing retrieval of lost luggage, the other of said opposing sides displaying markings relating to actual airline tickets; and a random number generating means adapted for use in identifying the number of landing sites to be advanced consecutively by each of said first game pieces during game play, said random number generating means also being adapted for use in identifying the need for player selection of one of said airline ticket cards during game play, and wherein said random number generating means comprises a pair of identically numbered dice.

14. The board game apparatus of claim 13 further comprising a plurality of tokens adapted for use by game players to record completion of said flight segments, and wherein said game board is adapted for compact storage.

15. The board game apparatus of claim 13 wherein each of said first game pieces and each of said second game pieces is dimensioned according to a 1:36 scale, each of said first game pieces has a height dimension of approximately two inches, and further wherein said circuitous path comprises approximately four dozen of said landing sites.

16. A method of playing a board game relating to airplane travel and periodic loss and retrieval of luggage which becomes a focal point of same play, said method comprising the steps of:

providing at least two players, a number of traveler game pieces identical to the number of said players, a number of luggage game pieces identical to the number of said traveler game pieces, said luggage game pieces each being distinctly marked for association with a different one of said traveler game pieces, a planar game board having a circuitous perimeter travel path with one enlarged start/finish square adapted to resemble an airport for indicating the beginning and conclusion of one flight segment and also adapted to identify a preferred direction of play, said travel path also having a plurality of landing sites contiguous with one another and with said start/finish square, each of said landing sites having at least one airplane travel related message thereon adapted to affect traveler game piece movement, an airline ticket card holding area, a lost luggage holding area, a pair of identically numbered dice, and a plurality of airline ticket cards having airplane travel related instructions thereon adapted to affect traveler game piece movement;

prior to movement of a first one of said traveler game pieces along said travel path on said game board, identifying a number of said flight segments needed to determine a winner by general player consensus, positioning all of said airline ticket cards upon one another in a single stack within said airline ticket card holding area with said instructions on each of said airline ticket cards hidden from view, each of said players selecting one of said traveler game pieces for movement along said travel path during game play, connecting each of said luggage game pieces to the one of said traveler game pieces intended for association therewith, placing each of said traveler game pieces upon said start/finish square, and choosing one of said players to be a first player to advance a selected traveler game piece along said travel path in said preferred direction of play;

said first player rolling said pair of dice onto a flat surface to determine a first random number represented by the sum of numbers facing upward on both of said dice after rolling when said dice cease movement;

said first player moving the selected one of said traveler game pieces, hereinafter referred to as said first traveler game piece, in said preferred direction of play and thereafter positioning said first traveler game piece upon the one of said landing sites corresponding to said first random number as counted from said start/finish square and hereinafter identified as a first landing site;

performing according to said movement affecting messages on said first landing site and when said messages include a direction to lose luggage, separating said associated luggage game piece from said first traveler game piece, hereinafter in a separated state being referred to as said first separated luggage game piece, and placing said first separated luggage game piece into said lost luggage holding area on said game board;

also selecting a top one of said airline ticket cards when said first random number was formed by a pair of identical numbers on said dice;

performing according to said movement affecting airplane travel related instructions on said top airline ticket card, and when said instructions include a direction to retrieve luggage, retrieving said first separated luggage game piece from said lost luggage holding area and reconnecting said first separated luggage game piece to said first traveler game piece;

after completing action according to said airplane travel related instructions on said selected airline ticket card, said first player returning said selected airline ticket card to the bottom of said stack of airline ticket cards in said airline ticket card holding area for reuse;

when said first player cannot take any action according to said selected airplane ticket card, and if said selected airplane ticket card includes a directive to find luggage and said first player does not already hold one of said airplane ticket cards having airplane travel related instructions identical thereto, in an alternative to returning said selected airline ticket card to said airline ticket card holding area for reuse, said first player opting to retain said selected airline ticket card for future use;

when said first player cannot take any action according to said selected airline ticket card, and if said selected airline ticket card includes a directive to continue advancement along said travel path toward said start/finish square and said first player does not already hold one of said airline ticket cards having airplane travel related instructions identical thereto, in an alternative to returning said selected airline ticket card to said airline ticket card holding area for reuse, said first player opting to retain said selected airline ticket card for future use;

when applicable, said first player surrendering a retained one of said airline ticket cards to permit advancement of said selected first traveler game piece if said selected first traveler game piece would be otherwise unable to move according to said dice and after such surrender placing said retained airline ticket card under said stack of airline ticket cards in said airline ticket card holding area for reuse;

repeating for each of said players in succession said steps of rolling said dice, moving the selected one of said traveler game pieces in said preferred direction of play to the one of said landing sites indicated by said random number generated with said dice, performing according to said messages on the random-number-indicated one of said landing sites, selecting one of said airline ticket cards when indicated to do so by identical numbers generated with said dice, following instructions on the selected one of said airplane ticket cards, and optionally surrendering retained ones of said airline ticket cards where appropriate to reverse said landing site messages until one of said players is able to reach said start/finish square by exact count and accompanied by original luggage to complete a first one of said flight segments, with said players each being given an option not to select one of said airline ticket cards when said player lands on said start/finish square, and said players each also being given an additional option not to move the selected one of said traveler game pieces according to said random number generated by said dice when the selected one of said traveler game pieces is positioned on a landing site in close proximity to said start/finish square and said player believes that advancement according to said random number would diminish a later opportunity for said player to advance according to a more commonly rolled number obtained on said dice; and if additional ones of said flight segments are needed to determine a winner, continuing to repeat for all of said players in succession said steps of rolling said dice, moving the selected ones of said traveler game pieces in said preferred direction of play to the one of said landing sites indicated by said random number generated with said dice, performing according to said messages on the random-number-indicated one of said landing sites, selecting one of said airplane ticket cards when indicated to do so by identical numbers generated with said dice, following directions on the selected one of said airline ticket cards, and surrendering retained ones of said airplane ticket cards where appropriate to reverse said landing site messages until the total number of completed circuits along said travel path by one of said players is identical to the number of flight segments established by said pre-game general player consensus as being needed to determine a winner.

17. The method of claim 16 further comprising the steps of providing a plurality of tokens and presenting one of said tokens to those of said players completing a flight segment each time said players access said start/finish square by exact count and with luggage.

* * * * *